US006170305B1

(12) United States Patent
Shen

(10) Patent No.: US 6,170,305 B1
(45) **Date of Patent: *Jan. 9, 2001**

(54) INTERCONNECT MECHANISM FOR DUAL LOCK

(76) Inventor: Mu-Lin Shen, No. 32, Lane 76, Fu-An Rd., Sec. 5, Tainan (TW)

( * ) Notice: Under 35 U.S.C. 154(b), the term of this patent shall be extended for 0 days.

This patent is subject to a terminal disclaimer.

(21) Appl. No.: 09/285,213

(22) Filed: Apr. 1, 1999

(51) Int. Cl.[7] ..... E05B 59/00
(52) U.S. Cl. ..... 70/107; 70/34
(58) Field of Search ..... 70/107, 417, 451, 70/452, 224, 118; 292/33–35, 336.3, 36, 37, 40, 21

(56) References Cited

U.S. PATENT DOCUMENTS

| | | | | |
|---|---|---|---|---|
| 3,910,613 | * | 10/1975 | Nolin | 70/107 |
| 3,999,789 | | 12/1976 | Maurits et al. | 70/107 |
| 4,129,019 | * | 12/1978 | Urdal | 70/107 |
| 4,418,552 | * | 12/1983 | Nolin | 70/107 |
| 4,838,053 | * | 6/1989 | Shen | 70/107 |
| 4,979,767 | * | 12/1990 | Lin | 70/107 |
| 5,657,653 | | 8/1997 | Hensley et al. | 70/107 |
| 5,881,585 | * | 3/1999 | Kang | 70/107 |
| 5,881,586 | * | 3/1999 | Shen | 70/107 |

* cited by examiner

*Primary Examiner*—Darnell Boucher
(74) *Attorney, Agent, or Firm*—Alan Kamrath

(57) ABSTRACT

An interconnect mechanism is provided for a dual lock of the type having a deadbolt, a deadbolt driving mechanism, a latch bolt, and a latch bolt driving mechanism with an inside handle. The interconnect mechanism includes a base plate adapted to be mounted to an inner side of a door. The base plate includes a flange wall on an outer face thereof which faces away from the door. The base plate further includes a wing on each of two lateral sides thereof, the flange wall including a top face, a lower portion, and an upper portion. A lower cam is rotatably mounted to the lower portion of the flange wall. The lower cam is operably connected to the inside handle to rotate therewith. The lower cam includes a lobe located above the top face of the flange wall. An upper cam is rotatably mounted to the upper portion of the flange wall. The upper cam is operably connected to the deadbolt driving mechanism. The upper cam includes a lobe located above the top face of the flange wall. A slide plate includes a vertical slot in each of two lateral sides thereof. Each vertical slot is extended through by an associated wing on the base plate, thereby allowing vertical sliding motion of the slide plate relative to the base plate. The slide plate includes an upper operative end operably connected to the lobe of the upper cam and a lower operative end operable connected to the lobe of the lower cam. Rotational movement of the inside handle causes rotation of the lower cam, vertical sliding movement of the slide plate, and rotation of the upper cam, thereby retracting the deadbolt and the latch bolt simultaneously.

20 Claims, 5 Drawing Sheets

INTERCONNECT MECHANISM FOR DUAL LOCK

BACKGROUND OF THE INVENTION

1. Field of the Invention

The present invention relates to an interconnect mechanism for dual lock, and more particularly to an interconnect mechanism for dual lock with simultaneous retraction of a latch bolt and deadbolt by an inside lever handle.

2. Description of the Related Art

It is known to provide door locks with a latch bolt lock, a deadbolt lock, and a mechanism interconnecting the latch bolt and the deadbolt so that in an emergency both bolts may be simultaneously retracted upon operation of a single actuating means provided on the inside of a door, thereby permitting rapid egress from a secured area. For example, U.S. Pat. No. 3,910,613 to Nolin issued on Oct. 7, 1975 discloses a panic proof lock set; U.S. Pat. No. 3,999,789 to Maurits et al. issued on Dec. 28, 1976 discloses a lock of the type enabling panic exit; and U.S. Pat. No. 4,129,019 to Urdal issued on Dec. 12, 1978 discloses a cartridge device for joining two independent lock devices.

U.S. Pat. No. 5,657,653 to Hensley et al. issued on Aug. 19, 1997 discloses a dual lock with simultaneous retraction of latch and deadbolt by an inside lever handle and uncoupler between the driving spindle and the lever handle to solve complex configurations in known mechanism for interconnecting the latch bolt to the deadbolt for simultaneous operation. It is, however, found that screws 178 might cause an obstacle to rotation of the upper cam 166 if the heads of screws 178 are not completely received in the countersunk holes 176. Similarly, screws 184 might cause an obstacle to rotation of the lower cam 160 if the heads of screws 184 are not completely received in the countersunk holes 182. In addition, the vertically extending ribs 175 on the trim plate 162 may have a difference in the heights thereof after manufacturing and thus cannot provide smooth sliding motion of the slide plate 164. Furthermore, the ribs 175 cannot provide sufficient structural strength to keep planar surface of the trim plate 162 for supporting smooth sliding motion of the slide plate 164. More specifically, the trim plate 162 might be bent during stacking and/or assembly. Further, two L-shaped brackets 172 are provided on each side of the trim plate 162 for guiding sliding motion of the slide plate 164. Formation of the brackets 172 is costly and troublesome and requires precision to avoid too-tight or too-loose engagement with the slide plate 164. Further, the interconnect mechanism 24 and the inside chassis assembly 18 are separate from each other before assembly such that, if the slide plate 164 has not yet engaged with the trim plate 162, the brackets 172 may deform if they are pressed during transportation or package. As a result, sliding motion of the slide plate 164 is not allowed.

The present invention is intended to provide an improved interconnect mechanism for a dual lock that mitigates and/or obviates the above problems.

SUMMARY OF THE INVENTION

It is a primary object of the present invention to provide an interconnect mechanism that is simple to assembly and provides reliable sliding motion of a slide plate.

It is another object of the present invention to provide an interconnect mechanism, wherein the slide plate is in a reliable sliding relationship with a base plate. The base plate is reinforced in structure by means of forming an oval flange wall on an outer face thereof.

In accordance with the present invention, an interconnect mechanism is provided for a dual lock of the type having a deadbolt, a deadbolt driving mechanism, a latch bolt, a latch bolt driving mechanism with an inside handle. The interconnect mechanism includes a base plate adapted to be mounted to an inner side of a door. The base plate includes a flange wall on an outer face thereof which faces away from the door. The base plate further includes a wing on each of two lateral sides thereof, the flange wall including a top face, a lower portion, and an upper portion. A lower cam is rotatably mounted to the lower portion of the flange wall. The lower cam is operably connected to the inside handle to rotate therewith. The lower cam includes a lobe located above the top face of the flange wall. An upper cam is rotatably mounted to the upper portion of the flange wall. The upper cam is operably connected to the deadbolt driving mechanism. The upper cam includes a lob located above the top face of the flange wall. A slide plate includes a vertical slot in each of two lateral sides thereof Each vertical slot is extended through by an associated wing on the base plate, thereby allowing vertical sliding motion of the slide plate relative to the base plate. The slide plate includes an upper operative end operably connected to the lobe of the upper cam and a lower operative end operable connected to the lobe of the lower cam. Rotational movement of the inside handle causes rotation of the lower cam, vertical sliding movement of the slide plate, and rotation of the upper cam, thereby retracting the deadbolt and the latch bolt simultaneously.

Other objects, advantages, and novel features of the invention will become more apparent from the following detailed description when taken in conjunction with the accompanying drawings.

DETAILED DESCRIPTION OF THE PREFERRED EMBODIMENT

It is appreciated that dual lock includes tubular lock/auxiliary lock and lever handle lock/auxiliary lock. The invention will be hereinafter explained with reference to an example of a dual lock of the lever handle lock/auxiliary lock type. Nevertheless, it is appreciated that the embodiment is described for illustrative purpose only, not to limit the invention.

Figure 1:
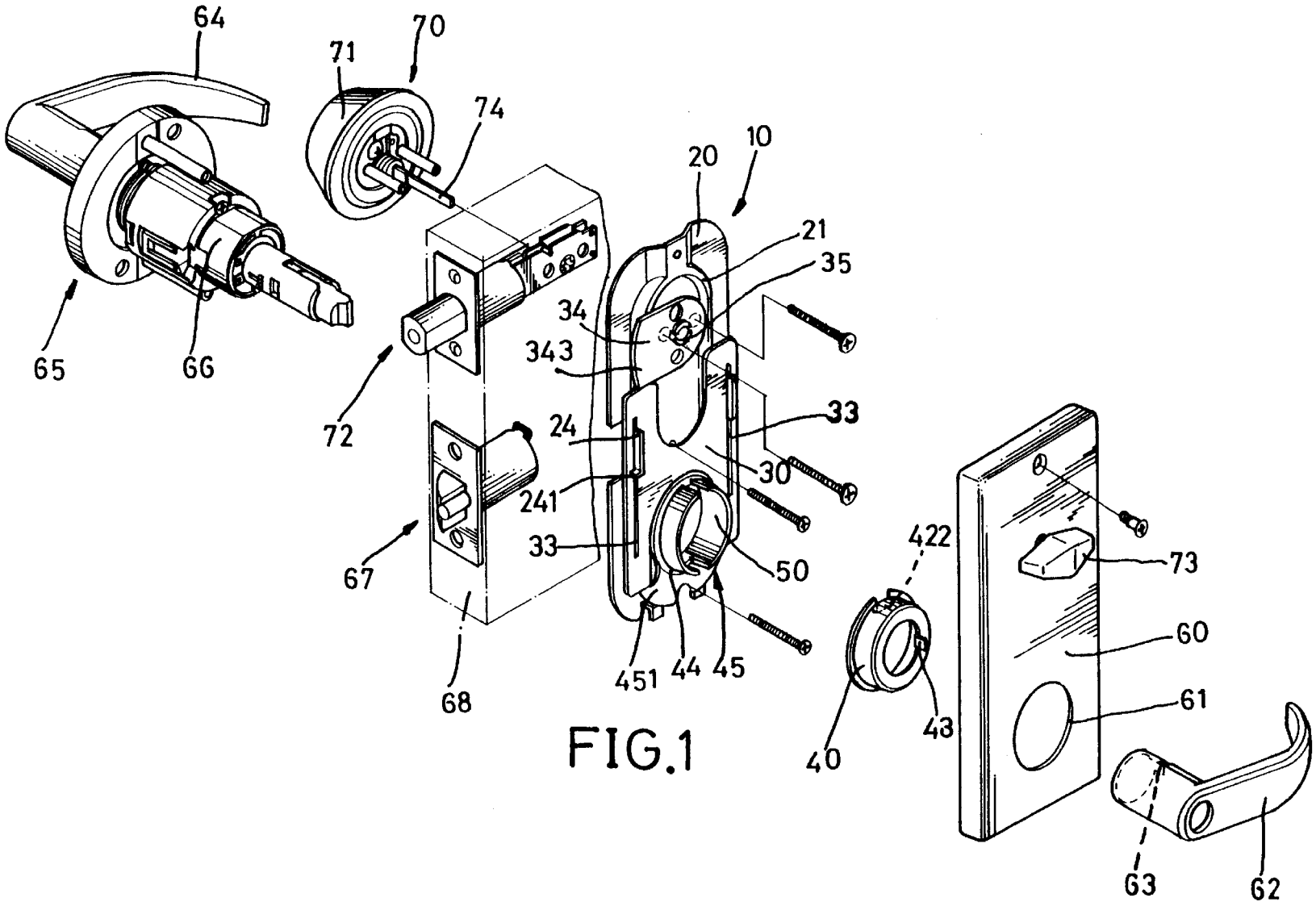
FIG. 1 is an exploded perspective view of a dual lock with an interconnect mechanism in accordance with the present invention.

Referring to FIG. 1, a dual lock in accordance with the present invention generally includes a lever handle lock 65, an auxiliary lock 70, and an interconnect mechanism 10. The auxiliary lock 70 includes a lock chassis 71 mounted to an outer side of a door 68, a deadbolt 72 in the door 68, and a thumbturn 73 mounted to an inner side of the door 68. The thumbturn 73 is retained in place by a washer 36 and a retainer ring 37 and is rotatable to actuate a deadbolt operating bar 74 for extending or retracting the deadbolt 72. The lever handle lock 65 includes a lock chassis 66, an outside lever handle 64, an inside lever handle 62 that extends through an opening 61 of a casing 60, and a latch bolt 67 mounted in the door 68. The latch bolt 67 may be retracted or extended by means of turning either handle 64, 62. Structure and operation of the lever handle lock 65 and the auxiliary lock 70 are conventional and therefore not described in detail.

Figure 2:
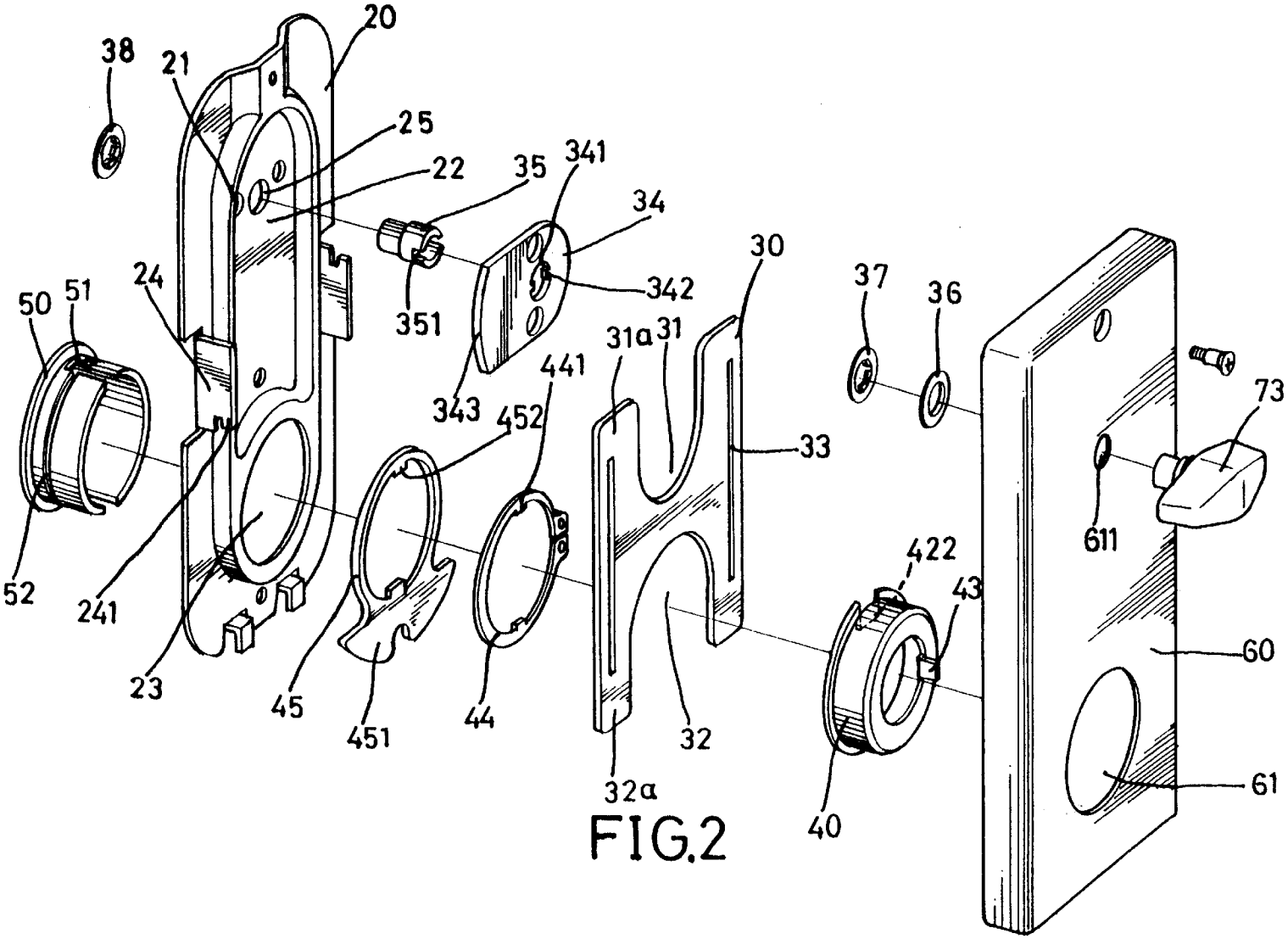
FIG. 2 is an exploded perspective view of the interconnect mechanism in accordance with the present invention.
Figure 3:
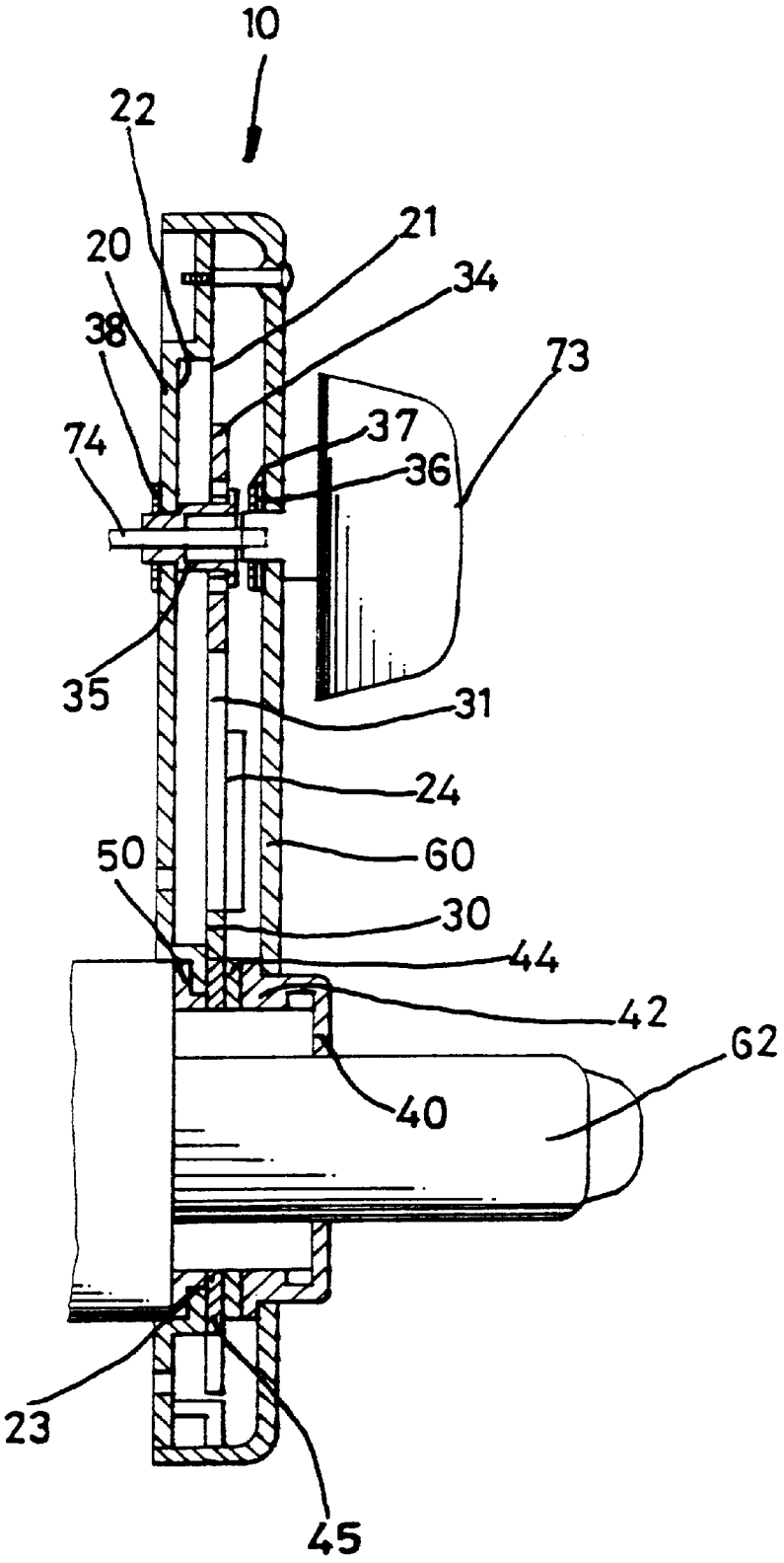
FIG. 3 is a side view, partly sectioned, of an inner portion of the dual lock.

The interconnect mechanism 10 is mounted to the inner side of the door 68 and housed by the casing 60. Referring to FIGS. 1 to 3, the interconnect mechanism 10 includes a base plate 20 secured to the inner side of the door 68, a lower cam device and substitute therefore including lower cam 45 and rotating wheel 50, a slide plate 30, and an upper cam 34. The base plate 20 includes an oval flange wall 21 on an outer face thereof, thereby defining an upper compartment 22 for accommodating heads of screws (not labeled) that secure the base plate 20 and the auxiliary lock 70 to the door 68. Thus, pivotal movement of the upper cam 34 and the lower cam 45 will not be impeded. The upper cam 34 is rotatably mounted to the base plate 20 by an axle rod 35. In this embodiment, the axle rod 35 includes a first end with two diametrically disposed slits 351 that engage with two diametrically disposed protrusions 342 in a hole 341 of the upper cam 34. A second end of the axle rod 35 extends through a hole 25 in the base plate 20 and is retained in place by a retainer ring 38, as shown in FIGS. 2 and 3. As can be seen from FIG. 1, a lobe 343 of the upper cam 34 rests on or located above a top face of the flange wall 21. As can be seen from FIG. 3, the deadbolt operating bar 74 extends through the axle rod 35 to the thumbturn 73, such that rotation of the upper cam 34 causes rotations of the axle rod 35, the deadbolt operating bar 74, and the thumbturn 73. The base plate 20 further includes two guide wings 24 on each of two lateral sides thereof, each wing 24 having a hook 241, which will be described later.

The lower cam device includes a rotating wheel 50 rotatably extended through the hole 23 of the base plate 20. The rotating wheel 50 is securely mounted around the lock chassis 66 of the lever handle lock 65 to rotate therewith. A lower cam 45 with a lobe 451 is secured to the rotating wheel 50 to rotate therewith. The rotating wheel 50 includes two diametrically disposed notches 51 for receiving two diametrically disposed protrusions 452 of a ring portion of the lower cam 45. Nevertheless, the rotating wheel 50 and the lower cam 45 may be integrally formed as a single cam. A retainer ring 44 is provided to secure the lower cam 45 and the rotating wheel 50 together. In this embodiment, the rotating wheel 50 includes an annular groove 52 for receiving the retaining ring 44, and the retainer ring 44 includes two diametrically disposed protrusions 441 received in the notches 51 of the rotating wheel 50.

A drive cap 40 is rotatably extended through the hole 61 of the casing 60 and includes an engaging piece 43 for securely engaging with a slot 63 in the inside lever handle 62 to rotate therewith. The drive cap 40 is also engaged with the rotating wheel 50 to rotate therewith. In this embodiment, the drive cap 40 is mounted around the rotating wheel 50 and includes two diametrically disposed tabs 422 received in the notches 51 of the rotating wheel 50. It is, nevertheless, appreciated that other devices may be used to connect the inside lever handle 62 and the lower cam 45.

The slide plate 30 includes two vertical slots 33 in two lateral sides thereof, respectively. Each wing 24 of the base plate 20 extends through an associated vertical slot 33 to allow vertical sliding motion of the slide plate 30 relative to the base plate 20. It is appreciated that the hook 241 in FIG. 2 is bent through 90° to a position shown in FIG. 1, thereby preventing disengagement of the slide plate 30. The slide plate 30 includes an upper recess 31 and a lower recess 32 so as not to interfere with rotation of the upper cam 34 and the lower cam 45, respectively. The slide plate 30 further includes a lower operative end 32*a* and an upper operative end 31*a*. The lower operative end 32*a* is operably connected to the lobe 451 of the lower cam 45, while the upper operative end 31*a* is operably connected to the lobe 343 of the upper cam 34.

Figure 4:
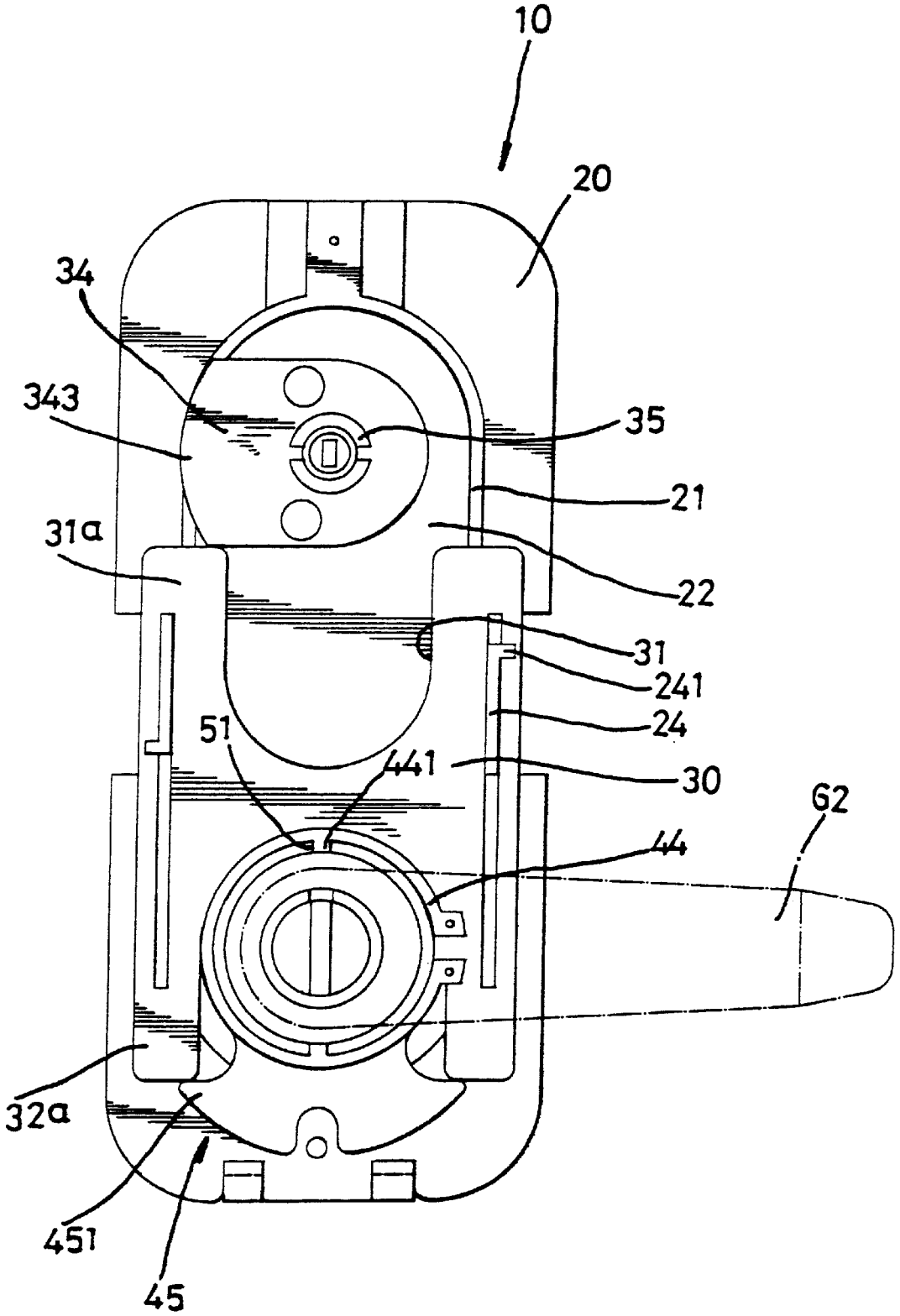
FIG. 4 is a front elevational view of the interconnect mechanism in accordance with the present invention in a latched status.
Figure 5:
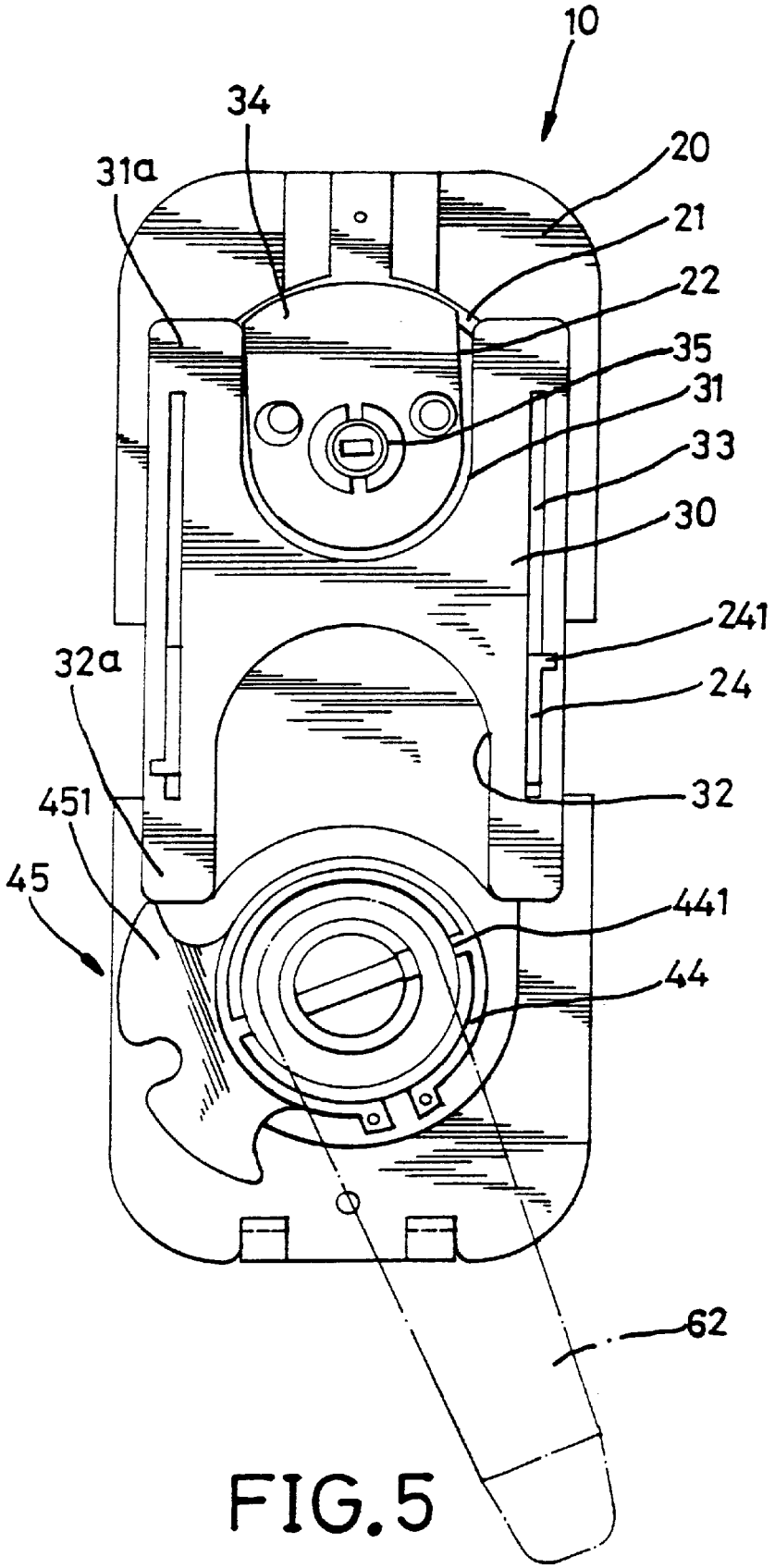
FIG. 5 is a view similar to FIG. 4, illustrating operation of the interconnect mechanism.

In use, referring to FIG. 4, the deadbolt 72 and the latch bolt 67 are in their extended positions. When the inside lever handle 62 is rotated through a predetermined angle in a direction (FIG. 5), the lobe 451 of the lower cam 45 actuates the lower operative end 32*a* of the slide plate 30. The slide plate 30 slides upward such that the upper operative end 3 la actuates the lobe 343 of the upper cam 34 and thus turns the upper cam 34. As a result, the deadbolt 72 is retracted (since the deadbolt operating bar 74 is rotated, as mentioned above) and the latch bolt 67 is also retracted (since the inside lever handle 62 is turned, as mentioned above). This allows the so-called "panic exit" or "emergency egress".

According to the above description, it is appreciated that the interconnect mechanism in accordance with the present invention has several advantages. Firstly, the structural strength of the base plate 20 is improved by means of providing the oval flange wall 21. The oval flange wall 21 also ensures smooth sliding movements of the slide plate 30 and smooth rotational movements of the upper cam 34 and the lower cam 45, as the screw heads for mounting the base plate 20 are located at a level lower that the top face of the oval flange wall 21. In addition, sliding motion of the slide plate 30 is reliable by means of providing the vertical slots 33 in the slide plate 30 and the wings 24 in the base plate 20. And processing of the vertical slots 33 and the wings 24 is much simpler than that required in U.S. Pat. No. 5,657,653.

Although the invention has been explained in relation to its preferred embodiment, it is to be understood that many other possible modifications and variations can be made without departing from the spirit and scope of the invention as hereinafter claimed.

What is claimed is:

1. An interconnect mechanism for a dual lock of the type having a deadbolt, a deadbolt driving mechanism, a latch bolt, a latch bolt driving mechanism with an inside handle, the interconnect mechanism comprising:

a base plate adapted to be mounted to an inner side of a door, the base plate including a flange wall on an outer face thereof which faces away from the door, the base plate further including a wing on each of two lateral sides thereof, the flange wall including a top face, a lower portion, and an upper portion;

a lower cam rotatably mounted to the lower portion of the flange wall, the lower cam being operably connected to the inside handle to rotate therewith, the lower cam including a lobe located above the top face of the flange wall, an upper cam rotatably mounted to the upper portion of the flange wall, the upper cam being operably connected to the deadbolt driving mechanism, the upper cam including a lobe located above the top face of the flange wall; and a slide plate including a vertical slot in each of two lateral sides thereof, each said vertical slot being extended through by an associated said wing on the base plate, thereby allowing vertical sliding motion of the slide plate relative to the base plate, the slide plate including an upper operative end operably connected to the lobe of the upper cam and a lower operative end operable connected to the lobe of the lower cam, whereby rotational movement of the inside handle causes rotation of the lower cam, vertical sliding movement of the slide plate, and rotation of the upper cam, thereby retracting the deadbolt and the latch bolt simultaneously.

2. The interconnect mechanism as claimed in claim 1, wherein each said wing includes a hook beyond the slide plate and extended in a direction transverse to the vertical direction to prevent disengagement of the slide plate from the base plate.

3. The interconnect mechanism as claimed in claim 2, wherein the slide plate has a first face and a second face, with each said vertical slot extending between the first and second faces, with the first face of the slide plate slideably abutting with the top face of the flange wall of the base plate.

4. The interconnect mechanism as claimed in claim 3, further comprising, in combination: a rotating wheel, with the base plate including a wheel hole through which the rotating wheel rotatably extends, with the lower cam being secured to the rotating wheel to rotate therewith.

5. The interconnect mechanism as claimed in claim 4, further comprising, in combination: a drive cap engaged with the rotating wheel to rotate therewith.

6. The interconnect mechanism as claimed in claim 5, further comprising, in combination: a casing including a cap hole through which the drive cap extends, with the drive cap being securely engaged with the inside handle to rotate therewith.

7. The interconnect mechanism as claimed in claim 6, wherein the slide plate includes a lower recess for receiving the rotating wheel so as not to interfere with rotation of the lower cam.

8. The interconnect mechanism as claimed in claim 7, further comprising, in combination: an axle rod, with the upper cam being rotatably mounted to the base plate by the axle rod, with the deadbolt driving mechanism including a deadbolt operating bar extending through the axle rod.

9. The interconnect mechanism as claimed in claim 8, where in the slide plate includes an upper recess for receiving the axle rod so as not to interfere with the rotation of the upper cam.

10. The interconnect mechanism as claimed in claim 9, further comprising, in combination: screws for securing the base plate to a door, with the screws having heads; wherein the flange wall defines an upper compartment for accommodating the heads of the screws.

11. The interconnect mechanism as claimed in claim 4, further comprising, in combination: an axle rod, with the upper cam being rotatably mounted to the base plate by the axle rod, with the deadbolt driving mechanism including a deadbolt operating bar extending through the axle rod.

12. The interconnect mechanism as claimed in claim 11, wherein the slide plate includes an upper recess for receiving the axle rod so as not to interfere with the rotation of the upper cam.

13. The interconnect mechanism as claimed in claim 1, further comprising, in combination: a rotating wheel, with the base plate including a wheel hole through which the rotating wheel rotatably extends, with the lower cam being secured to the rotating wheel to rotate therewith.

14. The interconnect mechanism as claimed in claim 13, further comprising, in combination: a drive cap engaged with the rotating wheel to rotate therewith.

15. The interconnect mechanism as claimed in claim 14, further comprising, in combination: a casing including a cap hole through which the drive cap extends, with the drive cap being securely engaged with the inside handle to rotate therewith.

16. The interconnect mechanism as claimed in claim 13, wherein the slide plate includes a lower recess for receiving the rotating wheel so as not to interfere with rotation of the lower cam.

17. The interconnect mechanism as claimed in claim 1, further comprising, in combination: an axle rod, with the upper cam being rotatably mounted to the base plate by the axle rod, with the deadbolt driving mechanism including a deadbolt operating bar extending through the axle rod.

18. The interconnect mechanism as claimed in claim 17, wherein the slide plate includes an upper recess for receiving the axle rod so as not to interfere with the rotation of the upper cam.

19. The interconnect mechanism as claimed in claim 1, wherein the slide plate has a first face and a second face, with each said vertical slot extending between the first and second faces, with the first face of the slide plate slideably abutting with the top face of the flange wall of the base plate.

20. The interconnect mechanism as claimed in claim 19, further comprising, in combination: screws for securing the base plate to a door, with the screws having heads; wherein the flange wall defines an upper compartment for accommodating the heads of the screws.

* * * * *